US012805614B2

(12) United States Patent
Armstrong

(10) Patent No.: US 12,805,614 B2
(45) Date of Patent: Nov. 24, 2026

(54) FLEXIBLE RING

(71) Applicant: Reed Tyson Armstrong, Calgary (CA)

(72) Inventor: Reed Tyson Armstrong, Calgary (CA)

( * ) Notice: Subject to any disclaimer, the term of this patent is extended or adjusted under 35 U.S.C. 154(b) by 0 days.

(21) Appl. No.: 18/963,689

(22) Filed: Nov. 28, 2024

(65) Prior Publication Data

US 2025/0169580 A1 May 29, 2025

Related U.S. Application Data

(60) Provisional application No. 63/604,035, filed on Nov. 29, 2023.

(51) Int. Cl.
*A44C 9/02* (2006.01)
*A44C 9/00* (2006.01)

(52) U.S. Cl.
CPC ..... *A44C 9/02* (2013.01); *A44C 9/0046* (2013.01)

(58) Field of Classification Search
CPC ..... A44C 9/02; A44C 9/0046
See application file for complete search history.

(56) References Cited

U.S. PATENT DOCUMENTS 2,146,272 A * 2/1939 Skoog ..... A44C 9/02 D11/35
3,221,514 A * 12/1965 Newman ..... A44C 9/02 D11/27
3,609,993 A * 10/1971 Graf ..... A44C 9/02 63/15.65
4,261,185 A * 4/1981 Martinez ..... A44C 9/02 63/15.6
6,003,334 A * 12/1999 Miller ..... A44C 9/02 63/15.5
6,748,764 B1 * 6/2004 Roemer ..... A44C 9/02 63/15.5
2002/0178749 A1 * 12/2002 Katano ..... A44C 9/02 63/15.7
2010/0083701 A1 4/2010 Huynh
2012/0180523 A1 7/2012 Meyerhoff et al.
2013/0326879 A1 * 12/2013 Alulis ..... A44C 9/0046 29/896.412
2017/0020243 A1 1/2017 Parikh
2018/0338587 A1 * 11/2018 Ghanimian ..... A44C 9/02

FOREIGN PATENT DOCUMENTS

CA 3005225 A1 11/2018

* cited by examiner

*Primary Examiner* — Emily M Morgan
(74) *Attorney, Agent, or Firm* — Franklin & Associates International Inc; Matthew F. Lambrinos

(57) ABSTRACT

An adjustable ring id provided, the ring including a crown portion; a belly band portion; a pair of arcuate rocker arms, each rocker arm having a first end rotatably connectable to the crown portion and a second end receivable in the belly band portion such that the second ends and the belly band can travel relative to one another; and one or more springs positioned relative to the rocker arms to provide resiliency to travel of the rocker arms relative to the belly band. Travel of the rocker arms relative to the belly band together with rotation of the rocker arms about a pivot axis of the crown portion allows the ring to resiliently expand and contract.

6 Claims, 12 Drawing Sheets

FLEXIBLE RING

CROSS-REFERENCE TO RELATED APPLICATIONS

This application claims the benefit of priority under 35 U.S.C. § 119 (e) based upon co-pending U.S. provisional patent application Ser. No. 63/604,035, filed on Nov. 29, 2023 at the United States Patent & Trade Mark Office, the entire contents of which is incorporated herein by reference.

FIELD

The disclosure relates to a self-adjusting ring that allows the wearer to don the ring and remove the ring without the ring becoming stuck.

BACKGROUND

Rings worn on the finger as jewelry or for other purposes need to be sized relative to a wearer's finger such that the ring is large enough to be easily donned and removed, but small enough not to accidentally fall off the finger. A common issue with rings is that swelling or shrinking of the thickness of the finger, and hence its diameter can lead to an otherwise sized ring becoming too tight or too loose for the finger. In the case of rapid swelling, due to, for example an injury or such, the ring may sometimes have to be cut off to be removed and to prevent loss of circulation to the finger.

Currently most jewelry manufacturers make rings with solid shanks and fixed ring diameters that have to be sized and also only can be worn while the size of the finger does not change.

Some designs for flexible rings exist but they are complicated and difficult to manufacture.

U.S. Pat. No. 6,003,334 teaches a finger ring size adjustment device that includes a ring shank and a cradle which is biased radially inward from the shank. The cradle is moveable between a retracted position and an adjusted position for reducing the ring size. The cradle is biased inwardly toward the adjusted position by a leaf spring in an automatically adjustable embodiment and a lever arm in an alternate embodiment.

US2012/0180523 teaches a jewelry shank having a ring configured to encircle a wearer's finger and a moveable tab positioned along the inner surface of the ring. The tab is shiftable between a retracted position that allows the shank to easily slide over a knuckle of the wearer's finger and an extended position that helps hold the shank in place on the wearer's finger after it has passed over the knuckle.

US20100083701 A1 teaches a ring including an annular shank having an inside circumferential surface with a channel extending therein. The inside circumferential surface has an effective first diameter. An arcuate spring having an effective second diameter smaller than the first diameter, being secured to the inside circumferential surface within the channel and having left and right inwardly extending portions; wherein the arcuate spring is adapted to resiliently expand as a wearer places his/her finger within the ring.

US20180338587 A1 teaches an adjustable shank adapted for resizing jewelry. A ring includes a head adapted to receive a stone; a shank including a first shank arm and a second shank arm, and each of the first and second shank arms include a ratchet member; a first joint coupling the first shank arm in movable engagement with the head, and a second joint coupling the second shank arm in movable engagement with the head. The first shank arm and the second shank arm remain coupled while being repositioned relative to each other to at least one of expand or contract a size of the shank.

US20170020243 A1 teaches an adjustable finger ring including a ring head having through holes on the bottom a first shank with a collar at one end and a split portion at the other end, and a second shank having a collar at one end and a split portion at the other end. The split portions may complement and overlap each other in an operative condition of the ring. A spring can be fitted inside the two collars so as to allow a pin to pass through. The spring allows the ring to expand while the split portions slide against one another.

U.S. Pat. No. 3,609,993 teaches a ring which is adjustable in size to accommodate different size fingers, having a top inner recessed portion, side pieces slidably engaging the top portion, the side pieces including limit profiles that engage a stop in the inner portion, to limit travel of the side pieces. In the extended position these limit profiles are exposed and can dig into or rub against the user's finger. Spring members mounted in the side pieces; these side pieces hinged to a bottom member so that the spring members will urge the side pieces inwardly into the recessed portion of the top member. Due to the shape of the side pieces, they tend to abut and scrape against an inner surface of the recessed portion of the top member.

CA 3,005,225 teaches an adjustable shank adapted for resizing jewelry. A ring includes a head adapted to receive a stone; a shank including a first shank arm and a second shank arm, and each shank arm include a ratchet member; and joints coupling each of the first and second shank arms in movable engagement with the head. The first shank arm and the second shank arm remain coupled while being repositioned relative to each other to at least one of expand or contract a size of the shank.

SUMMARY

An adjustable ring id provided, the ring including a crown portion; a belly band portion; a pair of arcuate rocker arms, each rocker arm having a first end rotatably connectable to the crown portion and a second end receivable in the belly band portion such that the second ends and the belly band can travel relative to one another; and one or more springs positioned relative to the rocker arms to provide resiliency to travel of the rocker arms relative to the belly band. Travel of the rocker arms relative to the belly band together with rotation of the rocker arms about a pivot axis of the crown portion allows the ring to resiliently expand and contract.

BRIEF DESCRIPTION OF THE DRAWINGS

Various objects, features and advantages of the disclosure will be apparent from the following description of particular embodiments of the disclosure, as illustrated in the accompanying drawings. The drawings are not necessarily to scale, emphasis instead being placed upon illustrating the principles of various embodiments of the disclosure. Similar reference numerals indicate similar components.

DETAILED DESCRIPTION

Figure 1C:
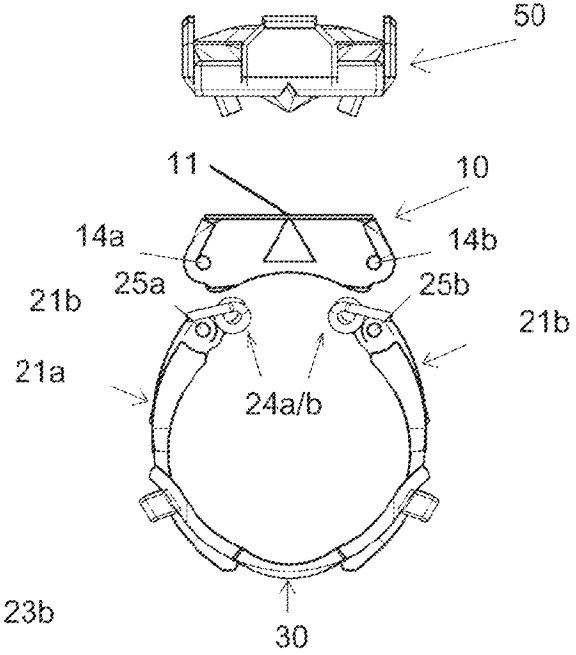
FIG. 1C is a partially exploded front elevation view of the self-adjusting ring of FIG. 1A, in a partially assembled arrangement.
Figure 1B:
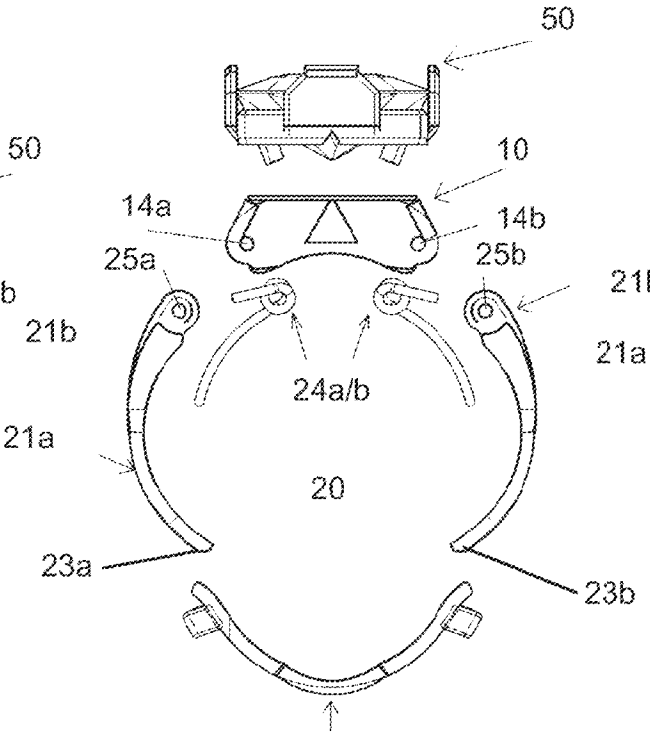
FIG. 1B is an exploded front elevation view of the self-adjusting ring of FIG. 1A.
Figure 1A:
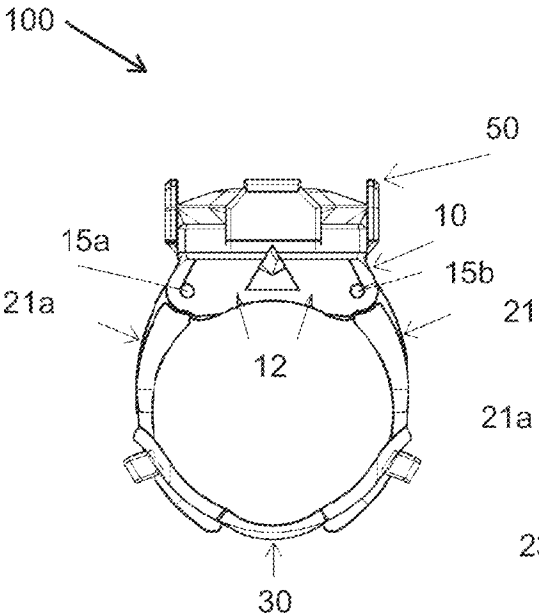
FIG. 1A is front elevation view of one embodiment of the present self-adjusting ring, in an assembled arrangement.
Figure 2C:
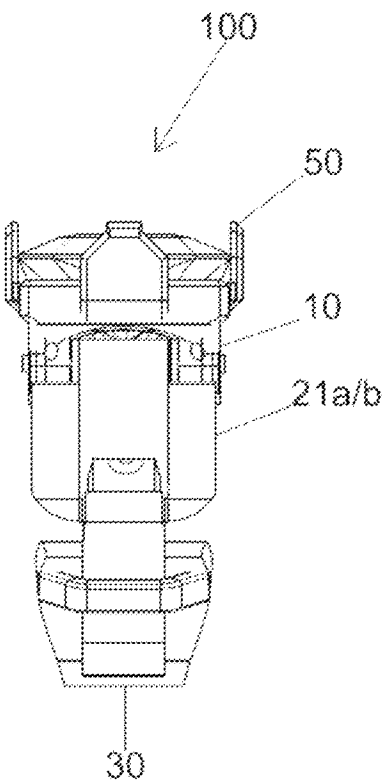
FIG. 2C is a side elevation view of the self-adjusting ring of FIG. 2A, in an assembled arrangement.
Figure 2B:
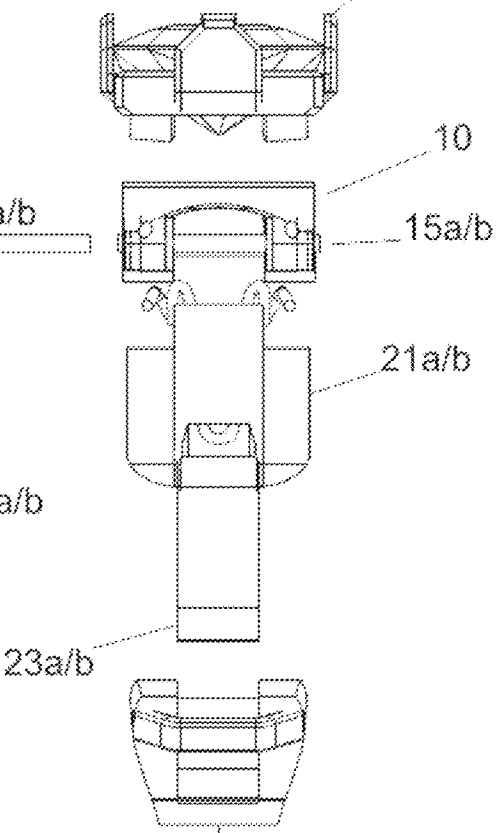
FIG. 2B is a partially exploded side elevation view of the self-adjusting ring of FIG. 2A, in a partially assembled arrangement.
Figure 2A:
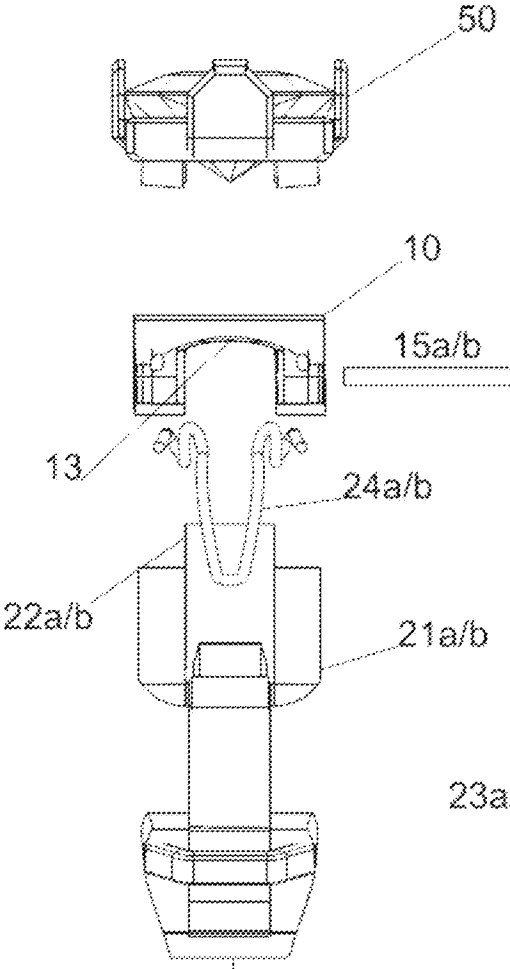
FIG. 2A is an exploded side elevation view of the self-adjusting ring of FIG. 1A.
Figures 3A, 3B, 3C, 3D:
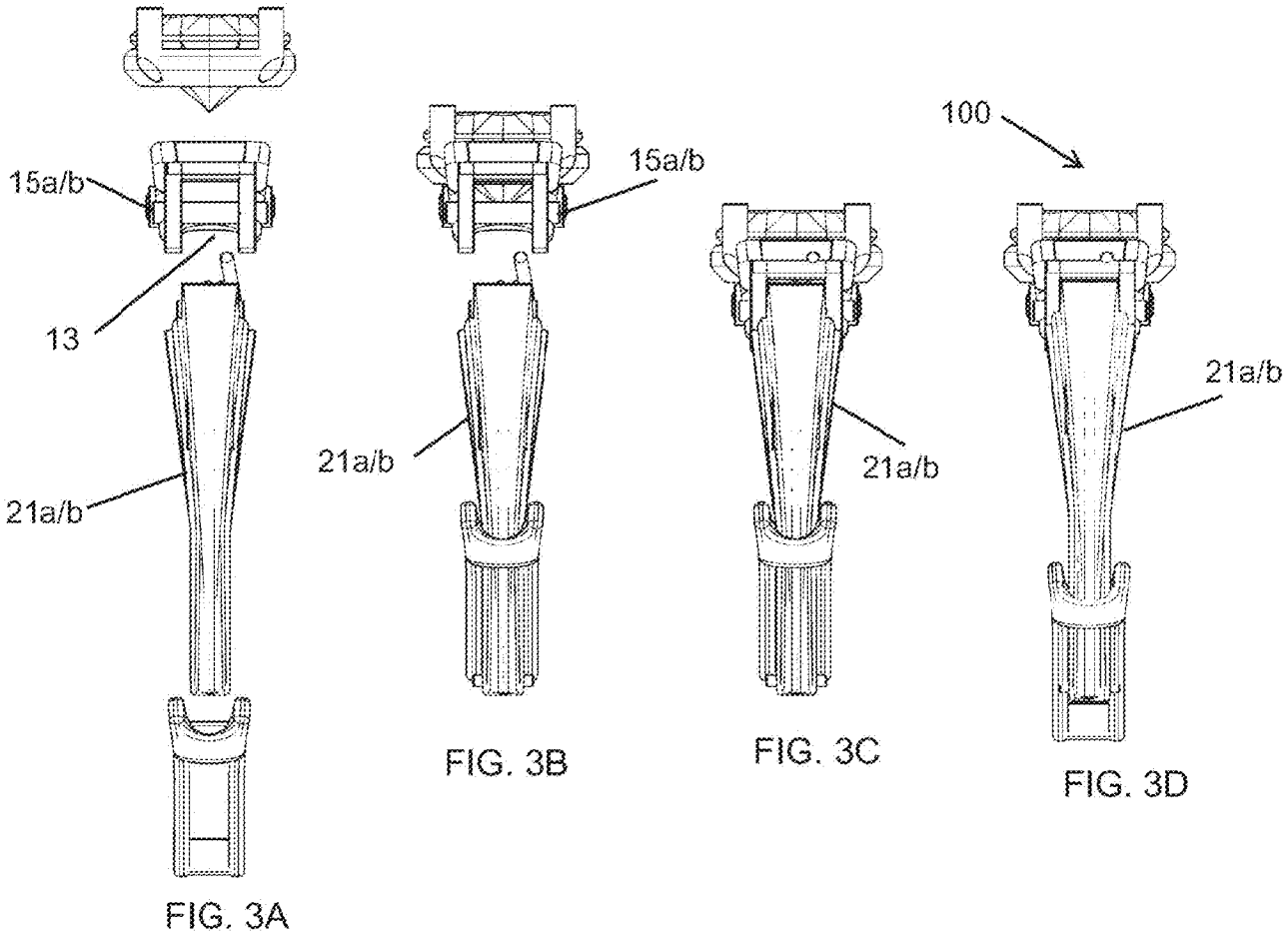
FIG. 3A is an exploded side elevation view of a second embodiment of the present self-adjusting ring.
FIG. 3B is a partially exploded side elevation view of the self-adjusting ring of FIG. 3A, in a partially assembled arrangement.
FIG. 3C is a side elevation view of the self-adjusting ring of FIG. 3A in a contracted position.
FIG. 3D is a side elevation view of the self-adjusting ring of FIG. 3A in an expanded position.
Figure 4D:
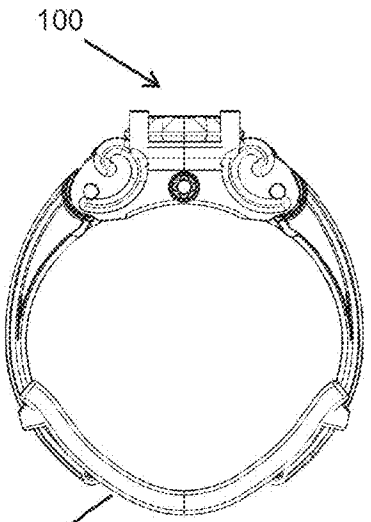
FIG. 4D is a front elevation view of the self-adjusting ring of FIG. 4A, in an expanded position.
Figure 4C:
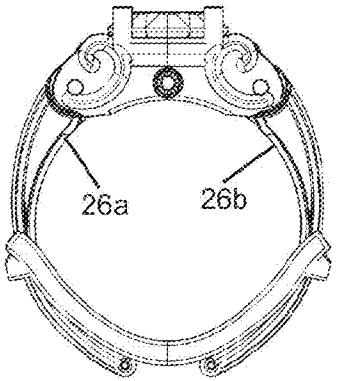
FIG. 4C is a front elevation view of the self-adjusting ring of FIG. 4A, in a contracted position.
Figure 4B:
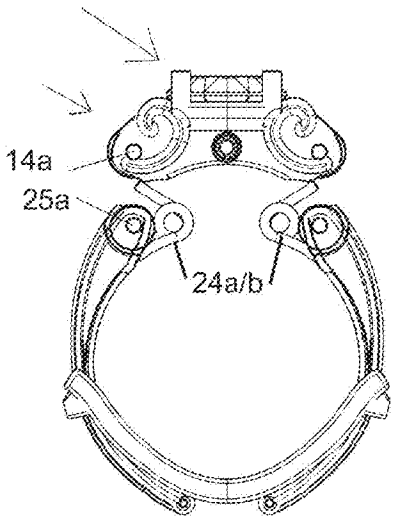
FIG. 4B is a partially exploded side elevation view of the self-adjusting ring of FIG. 4A, in a partially assembled arrangement.
Figure 4A:
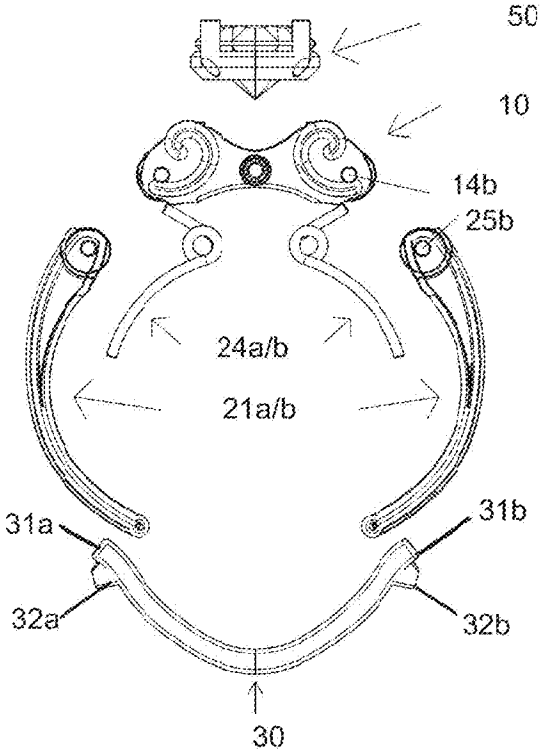
FIG. 4A is an exploded front elevation view of the self-adjusting ring of FIG. 3A.
Figures 5A, 5B, 5C, 5D, 5E:
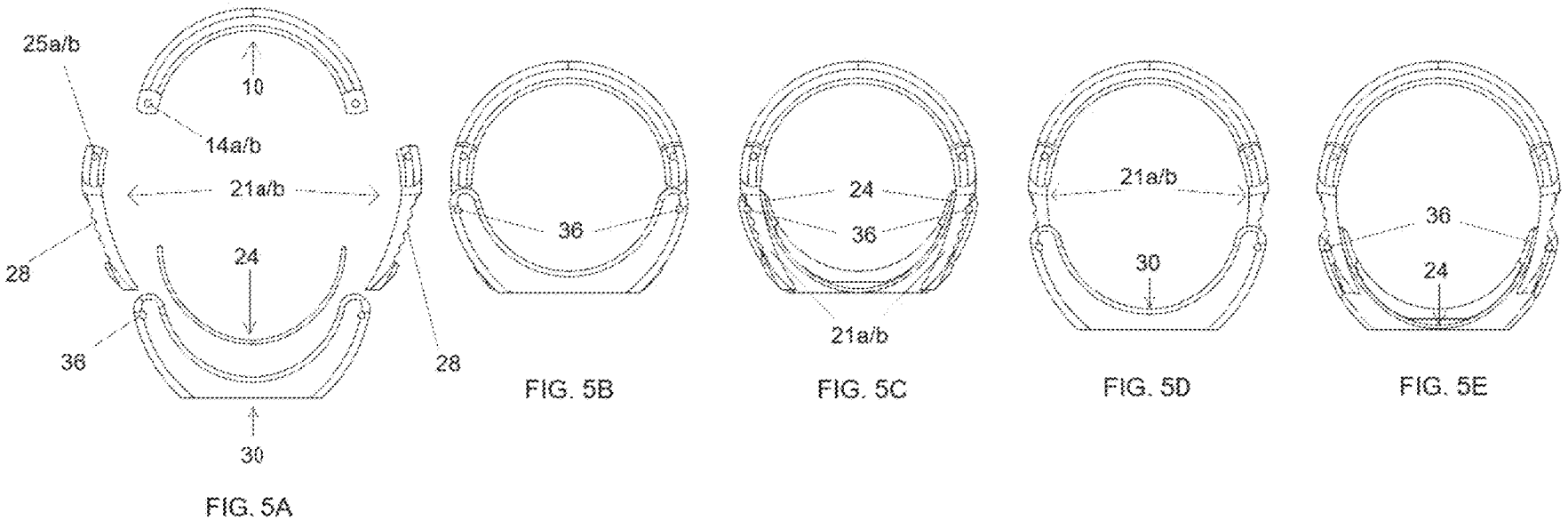
FIG. 5A is front elevation view of a third embodiment of the present self-adjusting ring, in an exploded arrangement.
FIG. 5B is a front elevation view of the self-adjusting ring of FIG. 5A, in a contracted position.
FIG. 5C is a cross-sectional view of the self-adjusting ring of FIG. 5A in a contracted position.
FIG. 5D is a front elevation view of the self-adjusting ring of FIG. 5A in an expanded position.
FIG. 5E is a cross-sectional view of the self-adjusting ring of FIG. 5A in an expanded position.
Figure 5G:
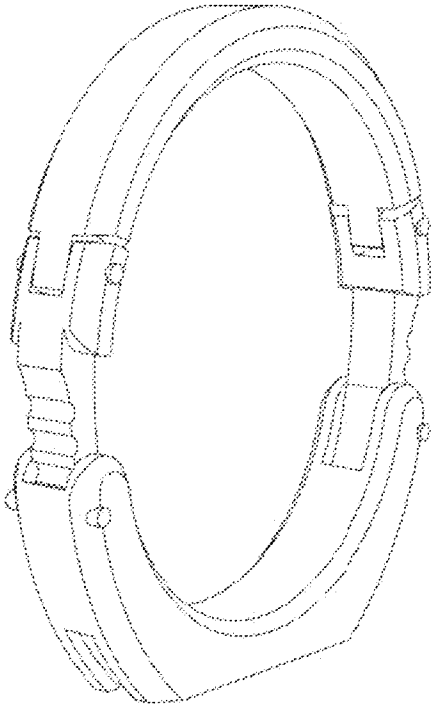
FIG. 5G is an isometric view of the self-adjusting ring of FIG. 5A in an expanded position.
Figure 5F:
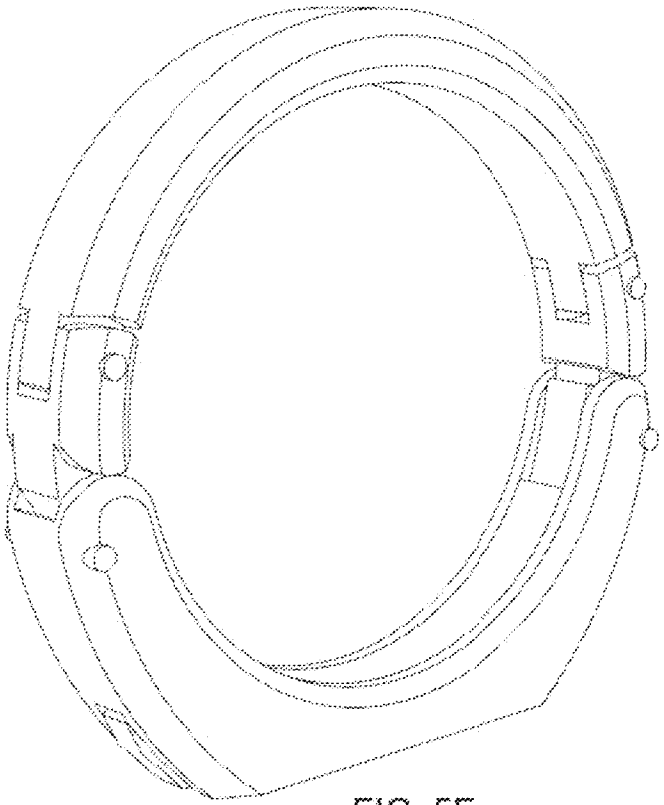
FIG. 5F is an isometric view of the self-adjusting ring of FIG. 5A in a contracted position.
Figure 6E:
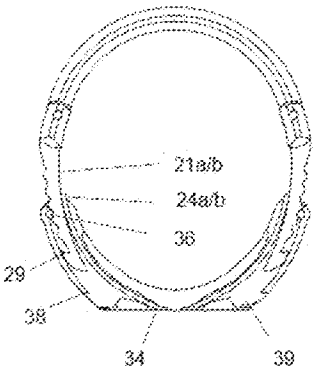
FIG. 6E is a cross-sectional view of the self-adjusting ring of FIG. 6A in an expanded position.
Figure 6D:
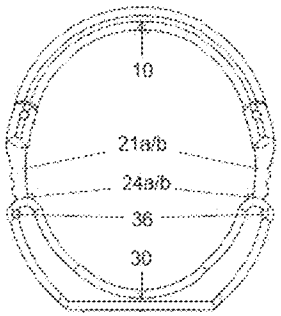
FIG. 6D is a front elevation view of the self-adjusting ring of FIG. 6A in an expanded position.
Figure 6C:
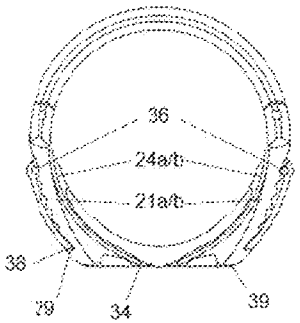
FIG. 6C is a cross-sectional view of the self-adjusting ring of FIG. 6A, in contracted position.
Figure 6B:
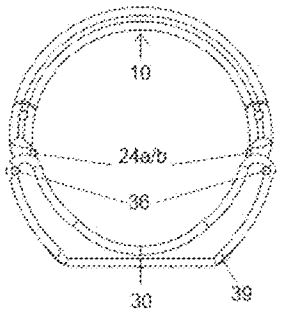
FIG. 6B is a front elevation view of the self-adjusting ring of FIG. 6A, in a contracted position.
Figure 6A:
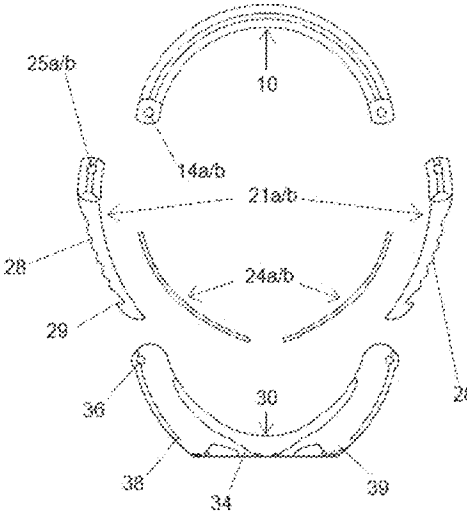
FIG. 6A is an exploded front elevation view of a fourth embodiment of a self-adjusting ring.
Figure 6G:
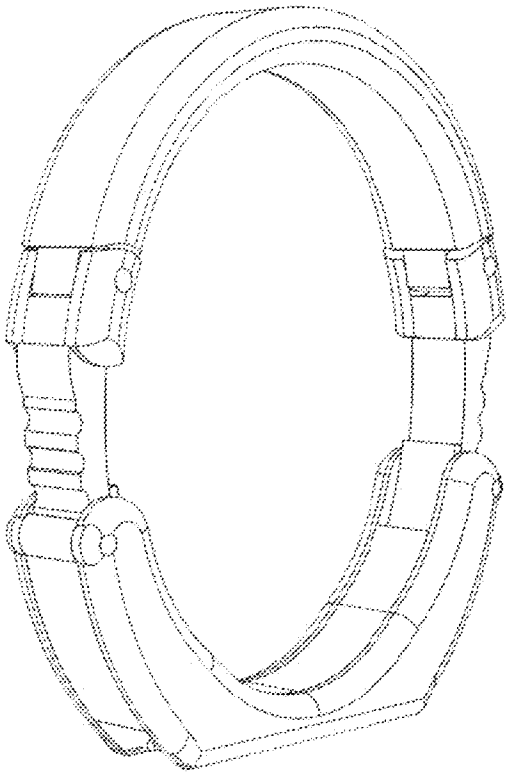
FIG. 6G is an isometric view of the self-adjusting ring of FIG. 6A in an expanded position.
Figure 6F:
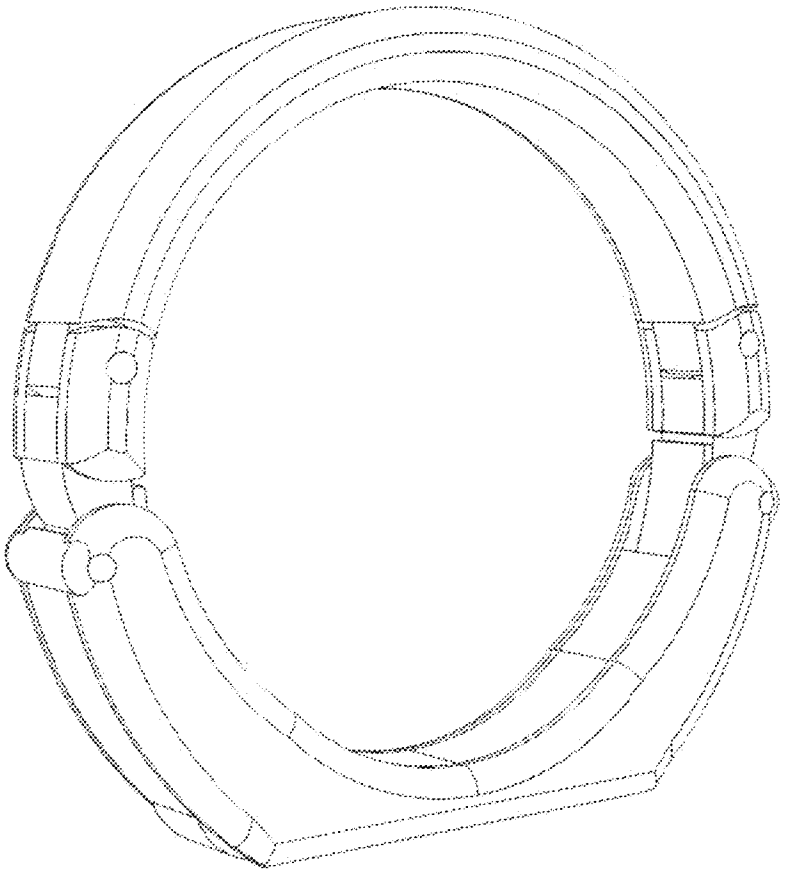
FIG. 6F is an isometric view of the self-adjusting ring of FIG. 6A in a contracted position.

With reference to the figures the present disclosure provides a self-adjusting, flexible ring.

All terms have definitions that are reasonably inferable from the drawings and description. Language used herein is to be interpreted to give as broad a meaning as is reasonable.

Various aspects of the disclosure will now be described with reference to the figures. For the purposes of illustration, components depicted in the figures are not necessarily drawn to scale. Instead, emphasis is placed on highlighting the various contributions of the components to the functionality of various aspects of the disclosure. A number of possible alternative features are introduced during the course of this description. It is to be understood that, according to the knowledge and judgment of persons skilled in the art, such alternative features may be substituted in various combinations to arrive at different embodiments of the present disclosure.

Rationale

The present self-adjusting ring 100 allows the wearer to don the ring and remove the ring without the ring becoming stuck and provides a degree of flexibility when the wearer bends their finger or on a swollen finger or knuckle. The present self-adjusting ring 100 includes a crown portion 10, a rocker arm assembly 20 and a belly band portion 30.

Crown Portion

With reference to FIGS. 1A to 4D, a crown portion 10 of the rings includes a top face 11 which can optionally receive a gemstone mount 50 for mounting gemstones in some embodiments of the self-adjusting ring 100. A bottom face 12 of the crown portion 10 includes a hollow channel 13 for receiving the rocker arm assembly 20, and two pairs of holes 14*a/b*, each pair of holes aligned in the bottom face 12 across the channel 13, for securing the rocker assembly 20 to the crown portion 10 by means of axle pins 15*a/b*.

Alternatively, with reference to FIGS. 5A to 9J the crown portion 10 may be absent of the channel 13, simply including holes 14*a/b* for securing the rocker assembly 20 to the crown portion 10.

Rocker Arm Assembly

The rocker-arm assembly 20 includes a pair of arcuate rocker arms 21*a/b* each having a first end 22*a/b* and a second end 23*a/b*. The first ends 22*a/b* are connected to the crown portion 10, such that when assembled, an inner surface 26*a/b* of each rocker arm is flush with the bottom face of 12 of the ring 100, to prevent any protruding parts and to present a smooth surface on an inside of the ring 100.

In the embodiment of FIGS. 1A to 4D, the first ends 22*a/b* of the rocker arms 21*a/b* are received into the channel 13 and a hole 25*a/b* in each first end 22*a/a* aligns with each pair of holes 14*a/b* formed in the bottom face 12 of the crown portion 10 when the rocker arms are received in the channel 13. The axle pins 15*a/b*, when inserted through the pairs of holes 14*a/b* and through holes 25*a/b*, rotatably secure the rocker arms 21*a/b* to the crown portion 10, allowing for rotation of the rocker arms 21*a/b* about the axle pins 15*a/b*. The arrangement is similar in the embodiments of FIGS. 5A to 9J, however with no channel, instead the holes 25*a/b* of first ends 22*a/b* are simply aligned with the holes 14*a/b* of the crown portion 10 and pinned together with pins 15*a/b* to form a hinging relationship.

As illustrated in FIGS. 1A to 4D, the rocker arms 21*a/b* are connected to the crown portion 10 in a resilient manner by means of engagement with springs 24*a/b*, said springs 24*a/b* being compressed between the bottom face 12 of the crown portion 10 and the first ends 22*a/b* of the rocker arms 21*a/b* to bias the rocker arms 21*a/b* inwardly towards one another.

The springs 24*a/b* can be coiled to form a U shape in embodiment of a wider and larger ring as depicted in FIGS. 1A to 2C, or to form a single coil for a narrow, smaller rings as depicted in FIGS. 3A to 4D.

The first ends 22*a/b* of the rocker arms 21*a/b* are preferably hollow or otherwise provided with a recess to receive the springs 24*a/b*, to thereby conceal and accommodate the springs 24*a/b* and reduce contact between a wearers finger and the springs 24*a/b*. Other configurations of the springs 24*a/b* are also possible to maintain a low profile and would be understood by those of skill in the art to be encompassed herein.

In a further embodiment, illustrated in FIGS. 5A to 6D, the springs 24*a/b* can take the form of a leaf spring or flat spring 24, or a pair of leaf springs 24*a/b* being compressed against the rocker arms 21*a/b* in a belly band 30 which is described in more detail below.

Belly Band Portion

With reference to FIGS. 1A to 4D, the belly band portion 30 preferably takes the form of an arcuate band having a first band end 31*a* and a second band end 31*b*. The first and second band ends 31*a/b* each include at least one retaining loop 32*a/b* for receiving the second ends 23*a/b* of each of the rocker arms 21*a/b*.

The belly band 30 preferably includes a recessed outer surface 33 such that when the second ends 23*a/b* are received into retaining loops 32*a/b* the rocker arms 21*a/b* are received into the recessed outer surface 33 to maintain a low profile of the self-adjusting ring 100. In this embodiment, the belly band 30 is free-floating such that it can travel up and down along the rocker arms 21*a/b* while being retained by the rocker-arms 21*a/b* as they are engaged within retaining loops 32*a/b*.

Optionally profiles (not shown) may be present on the outer sides of second ends 23*a/b*, said profiles interacting with retaining loops 32*a/b* when the self-adjusting ring 100 is fully expanded, to provide a limit to travel so that the belly band 30 does not fully disengage from the rest of the ring 100. As well, profiles with the retaining loops 32*a/b* provide a slight friction fit that holds the ring 100 in the fully expanded position without the springs 24*a/b* immediately pulling the ring back into a contracted state. This allows case of donning of the ring 100 and the slight friction fit is easily manually overcome to then allow the springs 24*a/b* to contract the ring in again to a comfortable fit about the user's finger.

In an alternate embodiment, as illustrated in FIGS. 5A to 9J, the belly band 30 is hollow to receive second ends 23*a/b* within the belly band 30. In this embodiment, the outer surface of the rocker arms 21*a/b* include grooves 28 along a length thereof. The grooves 28 are engageable with tabs 36 formed within the belly band 30 to incrementally expand and contract the ring 100 to adjust its fit. The grooves 28 can be progressed along the tabs 36 to either expand or contract the ring 100 by a firm pull or push of the crown portion 10 relative to the belly band 30. The second ends 23*a/b* may also include a hook profile 29 for engagement with a stop 38 formed within the belly band 30 to lock the ring 100 into place in a fully contracted position, which can be a target ring size for a user.

In the embodiment of FIGS. 5A to 9J, the springs 24 or 24*a/b* are positioned within the hollow of the belly band 30, against an inner surface 26*a/b* the rocker arms 21*a/b* to urge the second ends 23*a/b* of the rocker arms 21*a/b* outwardly against the belly band 30. In this embodiment, the belly band 30 may include openings 34 for inserting leaf springs 24*a/b*, said openings 34 which can be welded closed once the springs 24*a/b* are inserted.

Figure 7D:
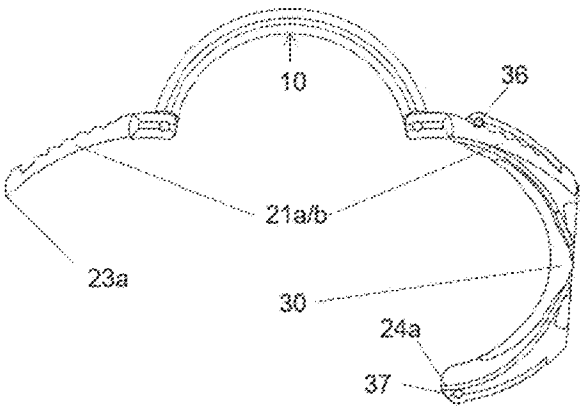
FIG. 7D is a cross-sectional view of the self-adjusting ring of FIG. 7A with one rocker arm in a fully removed and rotationally extended position.
Figure 7C:
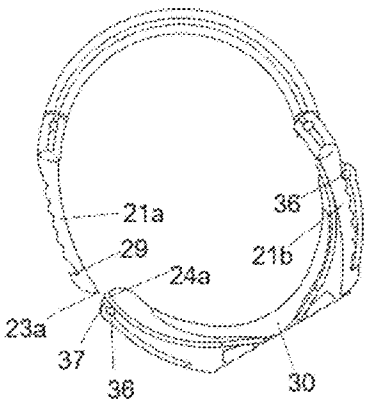
FIG. 7C is a cross-sectional view of the self-adjusting ring of FIG. 7A with one rocker arm in a full removed position.
Figure 7B:
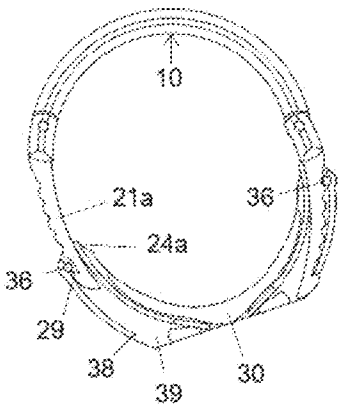
FIG. 7B is a cross-sectional view of the self-adjusting ring of FIG. 7A with one rocker arm in a partially removed position.
Figure 7A:
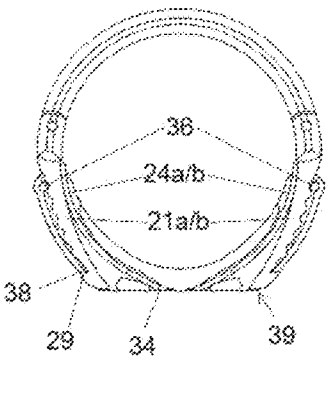
FIG. 7A is a cross sectional view of a self-adjusting ring in a contracted position.
Figure 7G:
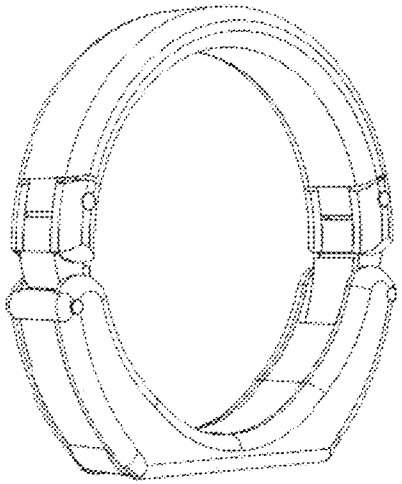
FIG. 7G is a cross-sectional view of the self-adjusting ring of FIG. 7A with one rocker arm in a partially removed position.
Figure 7F:
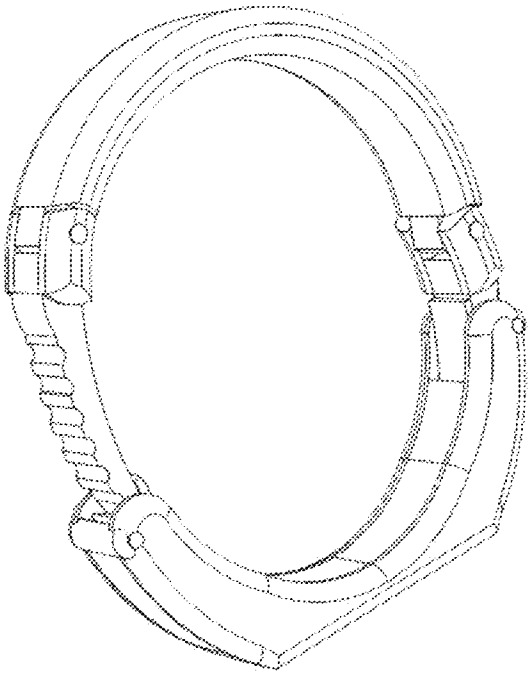
FIG. 7F is a cross-sectional view of the self-adjusting ring of FIG. 7A with one rocker arm in a partially removed position.
Figure 7E:
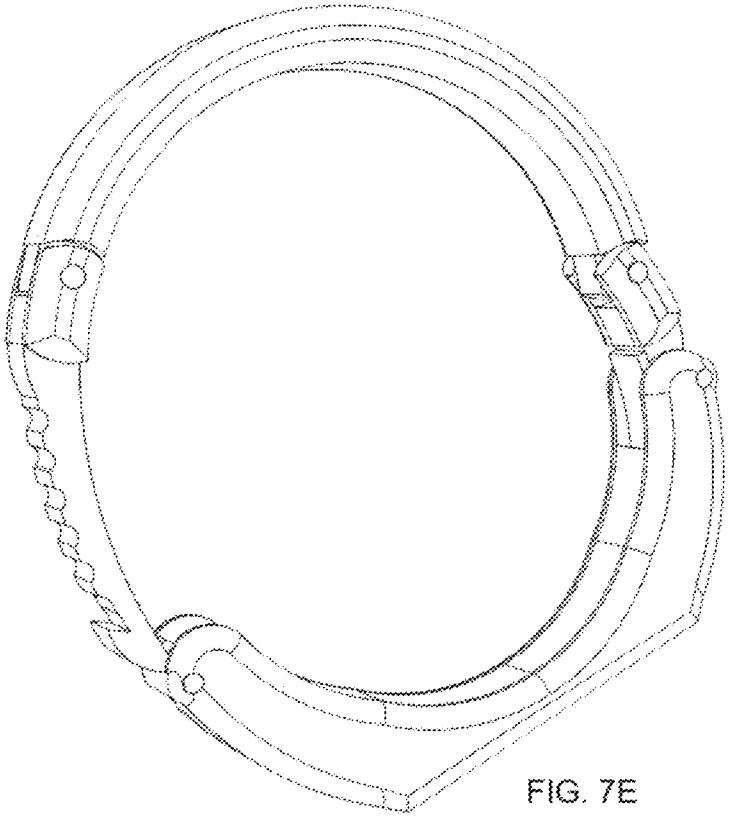
FIG. 7E is a cross-sectional view of the self-adjusting ring of FIG. 7A with one rocker arm in a partially removed position.
Figure 8E:
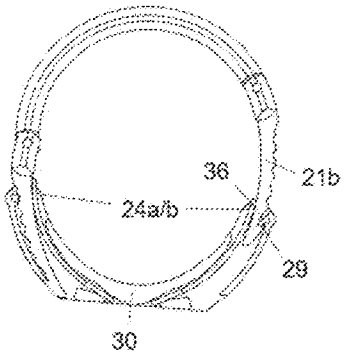
FIG. 8E is a cross-sectional view of the self-adjusting ring of FIG. 8A with one rocker arm further partially extended.
Figure 8D:
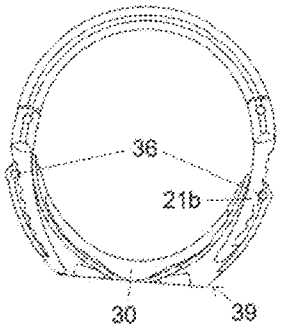
FIG. 8D is a cross-sectional view of the self-adjusting ring of FIG. 8A with one rocker arm partially extended.
Figure 8C:
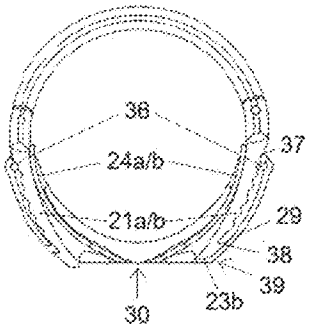
FIG. 8C is a cross-sectional view of the self-adjusting ring of FIG. 8A with one rocker arm urged radially inwardly to release hook from stop.
Figure 8B:
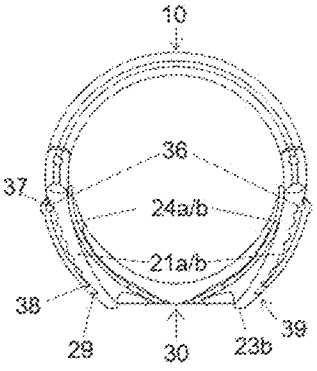
FIG. 8B is a cross-sectional view of the self-adjusting ring of FIG. 8A in a compressed position.
Figure 8A:
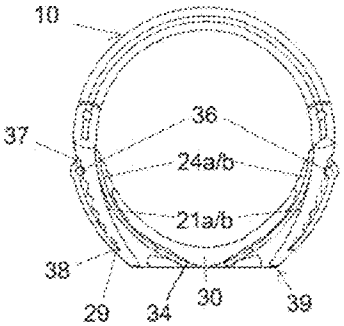
FIG. 8A is a cross-sectional view of a self-adjusting ring in a contracted position.

With reference to FIGS. 7A to 7G, the ring 100 may be fully opened by releasing one rocker arm 21*a* out of the belly band 30, and hinging the ring 100 along the opposite rocker arm 21*b*. Preferably, as seen in FIGS. 7C and 7D, an end of leaf spring 24*a* extends beyond tab 36 to define a small gap 37 through which the rocker arm 21*a* can be re-inserted and correctly positioned between the spring 24*a* and tab 36.

As illustrated in FIGS. 8A to 8E, further push tab openings 39, allow access to the second ends 23*a/b* of the rocker arms 21*a/b* such that the hook profile 29 can be manually released from the stop 38 by a user, to unlock the ring 100. In such circumstances, the crown portion 10 and belly band 30 are compressible towards one another to cause hook profiles 29 to protrude somewhat from the push tabs openings 39 such that they can be manually reached and pushed radially inwardly to release from stops 38.

Operation

The present self-adjusting ring 100 is designed to allow the belly band 30 to travel up and down along the rocker-arms 21*a/b*, which also pivot about axis pins 15*a/b* to expand under spring tension of the spring 24*a/b* when the wearer's finger increases in diameter bending or swelling, or for accommodating a wearer's knuckle when donning or removing the self-adjusting ring 100.

In some embodiments, the springs 24*a/b* serve to apply a constant inward pressure to the rocker arms 21*a/b* such that no manual adjustment is required to either expand or contract the ring 100. A swelling or change in diameter of the wearer's finger is sufficient to overcome the spring bias to automatically expand the ring 100. As mentioned earlier, the shape of the spring 24*a/b* as well as its stiffness can be set depending on the style of ring to which it is applied.

The present self-adjusting ring 100 can expand and contract up to 30% of its diameter, allowing for a range in finger diameters to be accommodated by the self-adjusting ring 100. The present self-adjusting ring 100 is preferably sized such that the ring 100 fits the wearer's finger in a fully contracted position, allowing for a full range of expansion as needed.

The present self-adjusting ring 100 does not rely on the rigidity or flexibility of the materials used to make the belly band 30, rocker arms 21*a/b* or crown portion 10. Instead, the present self-adjusting ring expands and contracts by movement some parts relative to other parts of the ring 100. As such, the present self-adjusting ring 100 can be used in both warm conditions and cold conditions without any change to operation.

The present self-adjusting ring 100 can optionally be used in a modular fashion. Specifically, the crown portion 10 and rocker arms 21*a/b* with springs 24 *a/b* can be used with a range of sizes of belly band 30, to allow for a larger range of ring sizing without the need for have a new crown portion 10 with new gemstone mount 50 and remounting of the gemstone.

Figure 9A:
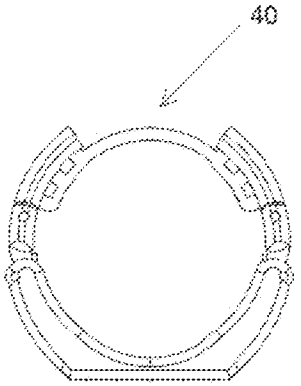
FIG. 9A is a front elevation view of a retrofit self-adjusting ring mount.
Figure 9B:
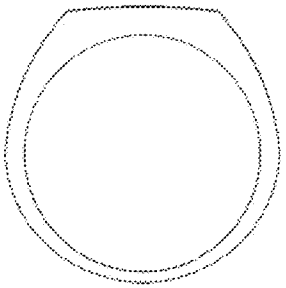
FIG. 9B is a front elevation view of a nonadjustable ring.
Figure 9C:
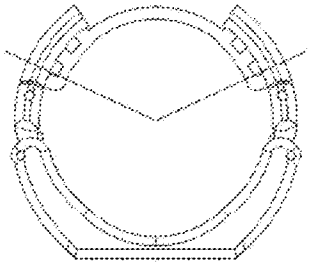
FIG. 9C is a front elevation view of the retrofit self-adjusting ring mount of FIG. 9A, showing a where a crown of the nonadjustable ring can be mounted.
Figure 9D:
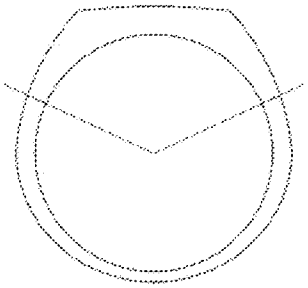
FIG. 9D is a front elevation view of the nonadjustable ring of FIG. 9B showing a demarcation by which a crown of the nonadjustable ring can be removed.
Figure 9E:
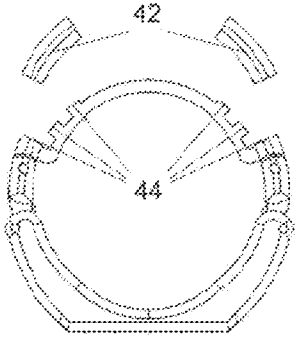
FIG. 9E is a front elevation view of the retrofit self-adjusting ring mount of FIG. 9A, with cutout ring portions removed.
Figure 9F:
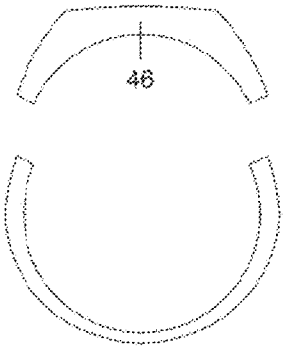
FIG. 9F is a front elevation view of the nonadjustable ring with crown removed.
Figure 9G:
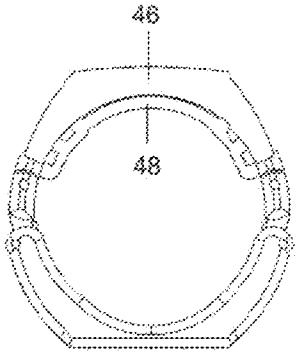
FIG. 9G is a front elevation view of the retrofit ring of FIG. 9A with the crown of the nonadjustable ring placed thereon.
Figure 9H:
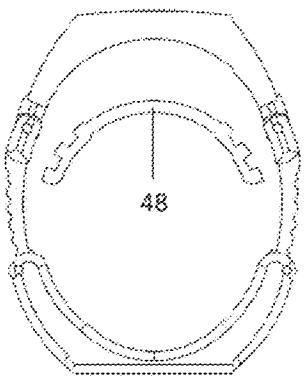
FIG. 9H is an exploded front view of the retrofit self-adjusting ring in an expanded position of FIG. 9A showing support under bridge.
Figure 9I:
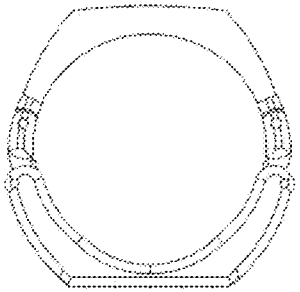
FIG. 9I is a front elevation view of the retrofit self-adjusting ring of FIG. 9A with the crown of the non-adjusting ring affixed thereon, in a contracted position.
Figure 9J:
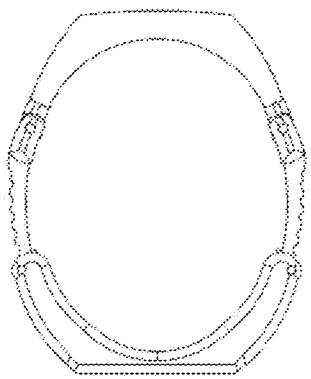
FIG. 9J is a front elevation view of the retrofit self-adjusting ring of FIG. 9A with the crown of the non-adjusting ring affixed thereon, in an expanded position.

Portions of the present self-adjusting ring 100 can also be used with a crown of an existing ring to modify or retrofit the existing ring to a self-adjusting ring. This embodiment is illustrated in FIGS. 9A to 9J, in which FIGS. 9A, 9C and 9E represent a mount 40 of the present self-adjusting ring 100, FIGS. 9B, 9D and 9F represent an existing nonadjustable ring and FIGS. 9G to 9J represent the stages of fitting a crown 46 of the nonadjustable ring onto the mount 40 of the self-adjusting ring. The mount 40 includes cut off portions 42 that are removable to expose mounting points 44 of an undermount support bridge 48 onto which the crown 46 can be mounted. The undermount bridge provides structure and rigidity to the ring 100 and a support to line up and clamp the top crown 46. Once mounted, the crown 46 can be affixed to the mount 40 by soldering, welding or riveting. After welding the under-mount bridge 48 can be removed and the final adjustable ring is shown in FIG. 9I in contracted position and 9J in expanded position.

The present self-adjusting ring 100 can be made from precious metals like gold, platinum and sterling silver but any metal or suitable durable material could be also used including but not limited to plastics, wood, resins, polymers, stainless steel, titanium as well as out of combinations of metals and plastic polymers, Nylon et cetera.

More preferably, the present self-adjusting ring 100 is made by 3D printing a mold and then casting the ring.

The present self-adjusting ring can be cast using either vacuum casting or centrifugal casting machines, de-spurred and then preferably cold finished using rivets, or alternatively soldered or arc welded.

The present self-adjusting ring 100 can also be used for splinting, prosthetics, toe rings, or adornments for larger body parts. The present self-adjusting ring 100 can also be used for monitoring devices such as pulse oximeters, and in robotics for human-to-machine apparatus.

Human-to-machine interfaces include when humans wear robotic parts over existing appendages like the hands, in which the robotic parts can adjust in diameter by the present mechanism and are therefore more functionable and ergonomic for human use.

The present mechanism could also be used in manufacturing prosthetics that provide an ergonomic mounting solution for gripping onto amputated limbs.

Although the present disclosure has been described and illustrated with respect to preferred embodiments and preferred uses thereof, it is not to be so limited since modifications and changes can be made therein which are within the full, intended scope of the disclosure as understood by those skilled in the art.

The invention claimed is:

1. An adjustable ring, said ring comprising:

a. a crown portion;

b. a belly band portion;

c. a pair of arcuate rocker arms, each rocker arm having a first end rotatably connectable to the crown portion and a second end receivable in the belly band portion such that the second ends and the belly band can travel relative to one another;

d. one or more springs positioned relative to the rocker arms to provide resiliency to travel of the rocker arms relative to the belly band; and e. a hook profile included on each of the second ends of the rocker arms for engagement with a stop formed on an inner surface of each side of the belly band to lock the ring into place in a fully contracted position, wherein travel of the rocker arms relative to the belly band together with rotation of the rocker arms about a pivot axis of the crown portion allows the ring to resiliently expand and contract.

2. The adjustable ring of claim 1, wherein belly band is hollow to receive second ends of the rocker arms within the belly band and wherein the springs are positioned within the hollow of the belly band, against a radially inner surface of the rocker arms to urge the second ends of the rocker arms radially outwardly against the belly band.

3. The adjustable ring of claim 2, wherein an outer surface of the rocker arms include grooves along a length thereof, said grooves being engageable with a tab formed on an inner surface of each side of the belly band, to incrementally expand and contract the ring to adjust its fit.

4. The adjustable ring of claim 3, wherein the belly band comprises openings for insertion of the one or more springs, said openings being closeable once the springs are inserted.

5. The adjustable ring of claim 4, wherein the ring may be fully opened by releasing one rocker arm out of the belly band and rotating the rocker arm about its rotatable connection to the crown portion.

6. The adjustable ring of claim 5, wherein the belly band comprises push tab openings to allow access to the second ends of the rocker arms such that the hook profile can be manually released from the stop to unlock the ring.

* * * * *